US008713722B2

(12) United States Patent
Inglin et al.

(10) Patent No.: US 8,713,722 B2
(45) Date of Patent: May 6, 2014

(54) FLUSHING ARRANGEMENT FOR A WC, AND METHOD OF OPERATING SUCH A FLUSHING ARRANGEMENT

(75) Inventors: Urs Inglin, Lachen (CH); Abdullah Oengoren, Simach (CH)

(73) Assignee: Geberit International AG, Jona (CH)

( * ) Notice: Subject to any disclaimer, the term of this patent is extended or adjusted under 35 U.S.C. 154(b) by 1106 days.

(21) Appl. No.: 12/714,067

(22) Filed: Feb. 26, 2010

(65) Prior Publication Data

US 2010/0242163 A1 Sep. 30, 2010

(30) Foreign Application Priority Data

Mar. 27, 2009 (EP) ..... 09405057

(51) Int. Cl.
*E03D 11/18* (2006.01)

(52) U.S. Cl.
USPC ..... 4/425

(58) Field of Classification Search
USPC ..... 4/420–442
See application file for complete search history.

(56) References Cited

U.S. PATENT DOCUMENTS

| | | | | |
|---|---|---|---|---|
| 1,785,198 | A | 12/1930 | Kelso | |
| 4,967,425 | A | 11/1990 | Kawamura et al. | |
| 4,987,616 | A * | 1/1991 | Ament | 4/421 |
| 5,317,763 | A * | 6/1994 | Frank et al. | 4/434 |
| 5,359,736 | A * | 11/1994 | Olivier | 4/448 |

FOREIGN PATENT DOCUMENTS

| | | | |
|---|---|---|---|
| EP | 1034338 | A1 | 9/2000 |
| EP | 1034338 | * | 9/2003 |
| WO | 95/04196 | A1 | 2/1995 |
| WO | 99/27203 | A1 | 6/1999 |
| WO | 2008/024005 | A2 | 2/2008 |

* cited by examiner

*Primary Examiner* — Lori Baker
(74) *Attorney, Agent, or Firm* — Sughrue Mion, PLLC

(57) ABSTRACT

A flushing arrangement for a WC, comprising a toilet bowl which has an inlet and an outlet, there between a U-bend, and pulse generating elements for generating a pulse with which water which is present in the U-bend and forms an air trap is accelerated, for a flushing operation, in the direction of the outlet. The pulse generating elements are arranged in the U-bend and have a plurality of nozzles, or at least one annular gap extending in the circumferential direction of the U-bend. The nozzles or the at least one annular gap generate, in the water in each case, a flow which is directed substantially towards the outlet. The nozzles or the at least one annular gap are arranged directly upstream of an ascending region or in an ascending region of the U-bend.

14 Claims, 5 Drawing Sheets

FLUSHING ARRANGEMENT FOR A WC, AND METHOD OF OPERATING SUCH A FLUSHING ARRANGEMENT

The invention relates to a flushing arrangement for a WC, having a toilet bowl which has an inlet and an outlet and between these, in a U-bend, means for generating a pulse with which water which is present in the U-bend and forms an air trap can be accelerated, for a flushing operation, in the direction of the outlet.

The consumption of flushing water can be significantly reduced in a WC if, according to the applicant's WO 95/04196, during flushing the water which is present in the U-bend is set in motion by a so-called jet nozzle. The water which the nozzle discharges into the U-bend at comparatively high speed can accelerate the water in the U-bend, in which case the U-bend is flushed out to better effect. The disadvantage is that the water which is introduced into the U-bend gives rise to additional noise and the action of the jet nozzle can be at least vastly reduced by solid matter in the U-bend.

EP-A-1034338 has disclosed a WC which has a so-called jet nozzle. The nozzle introduces a mixture of water and air into the base of the WC bowl. The nozzle has arranged at its front end a negative-pressure chamber which is intended to ensure that the water/air mixture is channeled in the direction of the axis of the entry of the U-bend, as is mentioned in paragraph [0027]. The introduction of the aforementioned mixture likewise appears to give rise to additional noise.

Tests have shown that, if solids are present in the U-bend, the accelerating action of the jet nozzle is vastly reduced.

It is an object of the invention to provide a flushing arrangement of the aforementioned type which avoids the aforementioned disadvantages.

The object is achieved according to Claim 1 in that the means for generating a pulse have a plurality of nozzles, or at least one annular gap extending in the circumferential direction of the U-bend, and these nozzles or this annular gap can be used to generate, in the aforementioned water in each case, a flow which is directed substantially towards the outlet.

In the case of the flushing arrangement according to the invention, a flow with a significantly higher pulse density can be generated in the water of the U-bend. The pulse density is significantly higher than that which can be generated with just one nozzle. The pulse which is generated in the case of the flushing arrangement according to the invention, in addition, is considerably more stable and is deflected significantly less by obstructions in the U-bend. The flow cone which is generated is directed, and concentrated, in the envisaged direction of action. This results in a more effective removal of solid objects. In addition, it has been found that, in the case of the flushing arrangement according to the invention, flushing gives rise to significantly smaller air bubbles in the U-bend and correspondingly finer turbulence. The noise is correspondingly low-level and less troublesome than the high-level noise which is generated if use is made of just one jet nozzle. Finally, it has been found that the desired suction function is built up significantly more quickly.

In a development of the invention, it is provided that at least one of the plurality of nozzles or the annular gap is arranged directly upstream of, or in, an ascending region of the U-bend. The nozzle or the annular gap is thus arranged at, or downstream of, the vertex of the U-bend. A particularly effective suction action can be generated as a result. The pulse which is generated by the nozzles or by the annular gap can give rise to the situation where the solid matter and the water remaining in the U-bend are sucked into the waste pipe in order for the expelled water to be replaced. This operation lasts until the entire contents of the toilet bowl are flushed out and the feeding of water to the nozzles or the annular gap is switched off.

It is preferable for more than two nozzles to be distributed over the circumference of the U-bend. An embodiment with just two nozzles, however, is also conceivable in principle. In this case, the two nozzles are preferably arranged approximately diametrically opposite one another. In particular, here, one nozzle is arranged at the bottom and one nozzle is arranged at the top. The annular gap preferably extends substantially around the entire circumference of the U-bend. It is also conceivable, however, to have an embodiment in which the annular gap extends only around part of the circumference, for example around half the circumference. An embodiment with more than one annular gap is also conceivable.

According to a development of the invention, it is provided that the circumference of the U-bend has arranged on it an annular connection line to which at least two nozzles or the annular gap are or is connected. Such an annular connection line makes it possible for the water or some other fluid provided to be distributed over the plurality of nozzles or over the annular gap. Such an annular line could run, in principle, in the wall of the U-bend or at a distance apart from the outside of the U-bend. Feeding then takes place preferably via an inlet pipe, which is connected to the connection nozzle.

According to a development of the invention, it is provided that the nozzles or the annular gap are or is provided for the feeding of water, air or a mixture of water and air. The nozzles are preferably provided for introducing water at a comparatively high pressure. However, it would also be possible, in principle, for the water which is present in the U-bend to be accelerated with air or a mixture of water and air.

Following emptying, or during emptying, of the U-bend, the toilet bowl is preferably cleaned in the region of the inlet by means of a main flushing operation. Provision is additionally made for the U-bend to be refilled with flushing water following the emptying operation. The water for accelerating the water in the U-bend can be fed, for example, from a flushing cistern. The flushing cistern may likewise provide the water for the main flushing operation. The flushing cistern here may be a conventional gravity-flow flushing cistern or else a pressure flushing cistern. Some of the water is then fed to the aforementioned nozzles or the at least one annular gap and the rest of the water is fed to the inlet of the toilet bowl.

The invention also relates to a method of operating a flushing arrangement. It is provided here that the water which is present in the U-bend is accelerated in the direction of the outlet by the plurality of nozzles or by the annular gap. It is therefore the case that the water, rather than being accelerated by just one nozzle, is accelerated by a plurality of nozzles or by an annular gap. A plurality of nozzles are provided, and correspondingly a plurality of flow cones are thus formed in the U-bend, these being directed substantially towards the outlet in each case.

Generation of the pulse in the U-bend can take place simultaneously with the main flushing operation, or the main flushing operation and the pulse generation take place one after the other.

Further advantageous features can be gathered from the dependent patent claims, from the following description and from the drawing.

Exemplary embodiments will be explained hereinbelow with reference to the drawing, in which.

Figure 1:
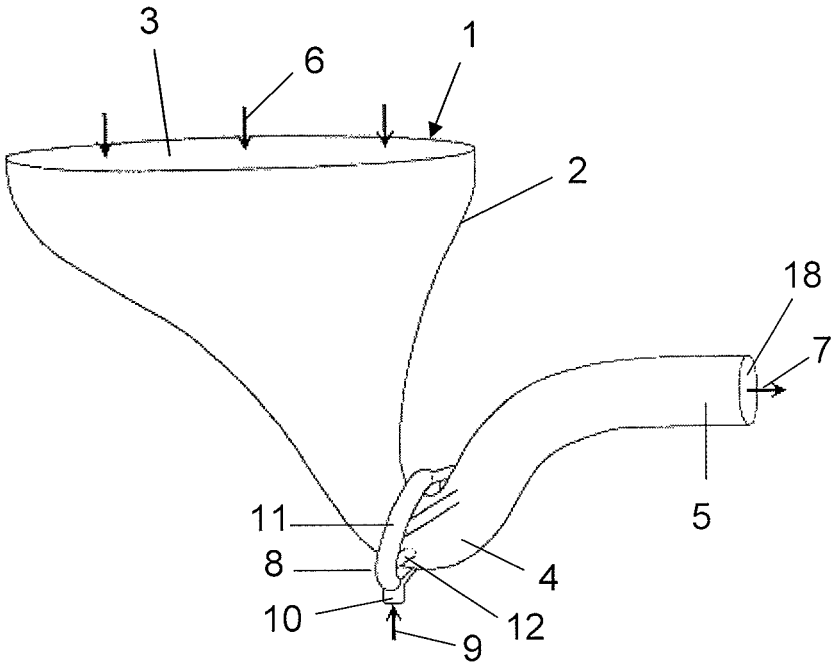
FIG. 1 shows, schematically, a view of a flushing arrangement according to the invention.
Figure 2:
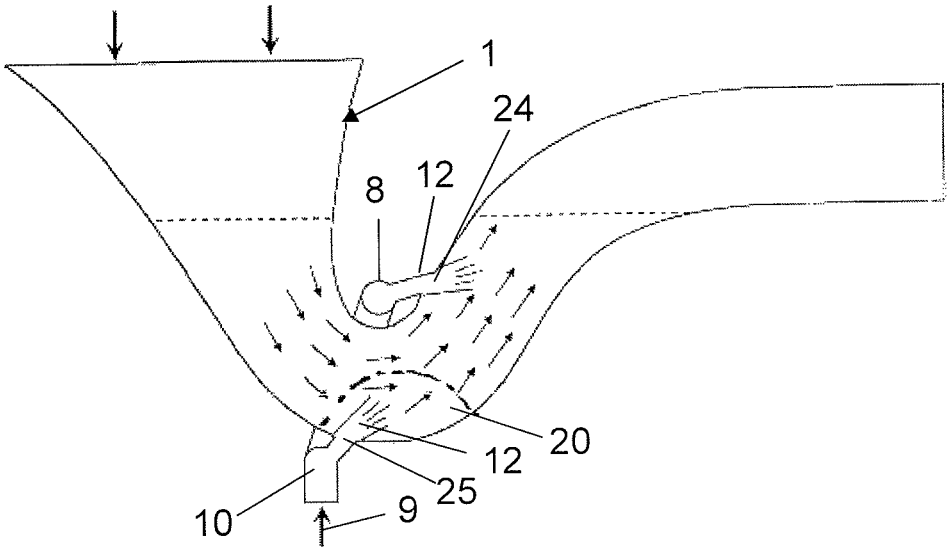
FIG. 2 shows a further schematic view of the flushing arrangement according to the invention, the water which is present in the U-bend having being accelerated.

The flushing arrangement 1 which is shown in FIGS. 1 and 2 has a WC bowl 2, for example made of ceramic material, which has an inlet 3 and an outlet 18. The inlet 3 and the outlet 18 have arranged between them a U-bend 4, in which water 13 is stored to form an air trap. The outlet 18 is arranged at the end of a waste pipe 5, which is connected in a conventional manner to a disposal line. During flushing, as is the case in the customary flushing channel (which is not shown here), water is fed in the direction of the arrows 6. In addition, the water 13 which is present in the U-bend 4 is accelerated by means of a pulse-nozzle arrangement 8. The pulse-nozzle arrangement 8 is used to generate a plurality of flow cones 15 in the water 13, these being directed towards the outlet 18. By means of the flow cones 15, the water 13 which is present downstream of the pulse-nozzle arrangement 8 is forced towards an interior 22 of the waste pipe 5 and thus upwards and towards the outlet 18. The rest of the water 13 which is present in the U-bend 4 is thus taken in by suction and likewise accelerated in the direction of the outlet 18. Solid matter 20 which is present here in the U-bend 4 is entrained and likewise conveyed in the direction of the outlet 18. If the U-bend 4 is substantially empty, then it is refilled again by the water which is fed at the inlet 3 via the aforementioned flushing channel. This water forms the basis for the main flushing operation, and the latter also cleans an inner side 23 of the WC bowl 2.

The pulse-nozzle arrangement 8 has a distributor ring 11 which, according to FIG. 1, extends around the U-bend 4. This distributor ring 11 is connected, via an inlet pipe 10, to a line which is not shown here. This line is, for example, a water line which is connected to a flushing cistern (not shown here), for example a pressure flushing cistern or a conventional gravity-based flushing cistern. The inlet pipe 10 is arranged, as can be seen, in the bottom region of the distributor ring 11. The water thus flows from beneath through the inlet pipe 10 into the distributor ring 11 and, in the latter, is distributed over a plurality of nozzles 12. The nozzles 12 open out, on an inner side of the U-bend 4, into the interior 22 of the WC bowl. A mouth 25 is located, according to FIG. 2, in a bottom region and substantially at the vertex of a region 4*c* of the U-bend 4. Another mouth 24 is located in an ascending region 4*b* of the U-bend 4. There are at least two nozzles 12 provided, these preferably being located, as shown, approximately diametrically opposite one another. It is also possible, however, to provide more than two nozzles 12, for example three, four or even more nozzles 12. These are distributed over the circumference of the U-bend 4. Distribution may be uniform or non-uniform. The pulse generated, or the flow cone, rather than being just at a certain point, is thus generated at a number of locations, in which case the water coming out of the nozzles 12 has a significantly higher pulse density and the water 13 can thus be subjected to very high dynamic forces. The water 13 is subjected to at least some of these forces downstream of the vertex of the U-bend 4, and this gives rise to the aforementioned suction action. The suction action is maintained until substantially the entire contents of the U-bend 4 have been flushed out. Since a plurality of nozzles 12 are provided, the various flow parameters can be set specifically for the U-bend 4.

Figure 3:
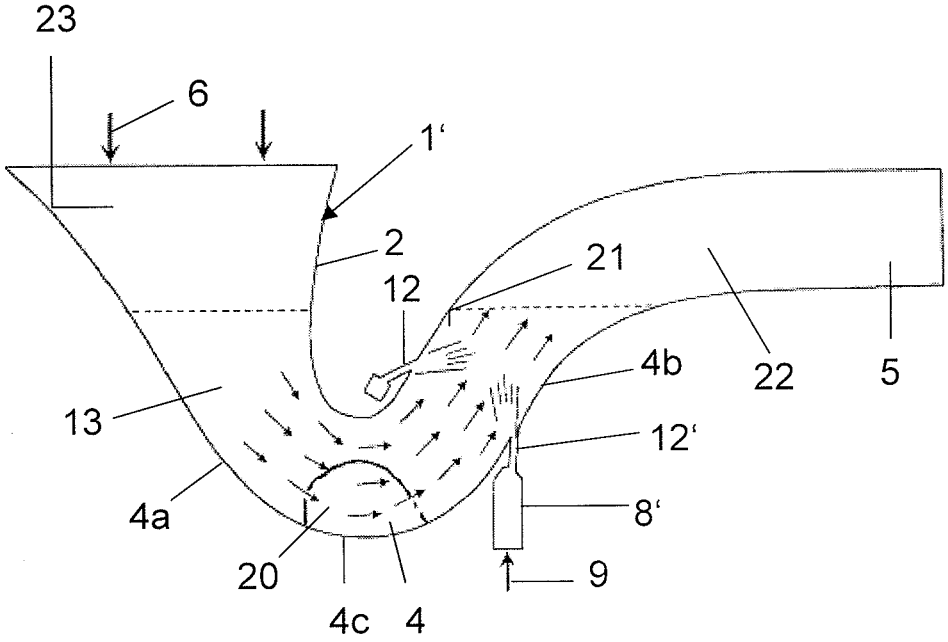
FIG. 3 shows a schematic view of a variant of a flushing arrangement.

FIG. 3 shows a flushing arrangement 1' which differs from the flushing arrangement 1 by the design of the pulse-nozzle arrangement 8'. This pulse-nozzle arrangement 8' likewise has a plurality of, that is to say at least two, nozzles 12', although in this case these are arranged exclusively downstream of the vertex of the U-bend 4, and thus in the ascending region 4*b*. This set-up generates a particularly good suction action in that the water 13 which is present in the ascending region 4*b* is moved, and/or accelerated, upwards and thus in the direction of the outlet 18. The water 13 which is present in the bottom region 4*c* and in the region 4*a* is likewise moved in the direction of the outlet 18 on account of the suction action. Since the nozzles 12' are arranged upstream of the solid matter 20, the flow cones 15 which are generated by the nozzles 12' cannot be deflected by this solid matter.

Figure 4:
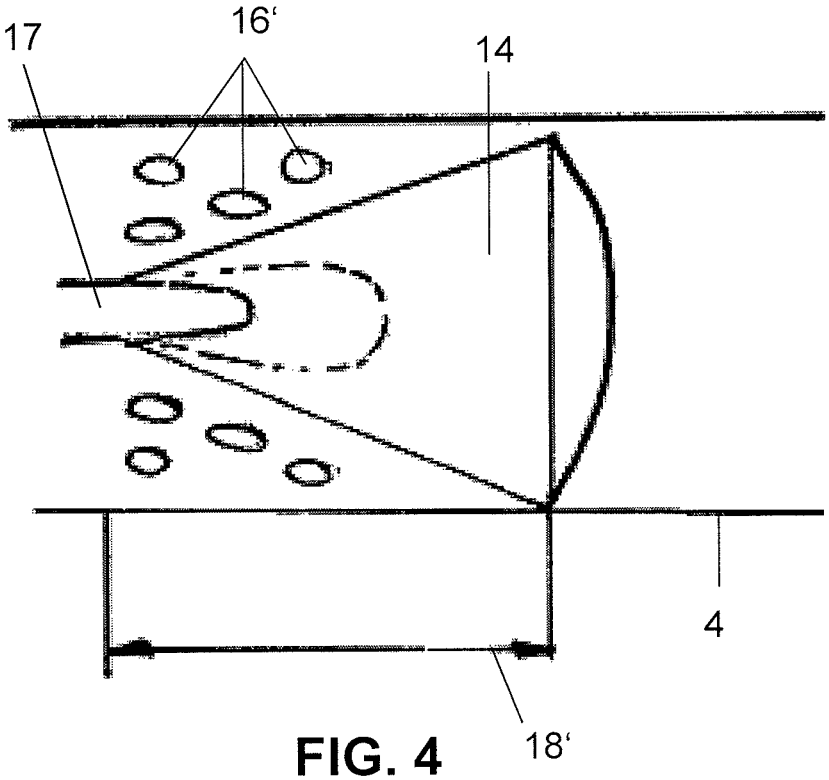
FIG. 4 shows, schematically, a partial section through a U-bend according to the prior art.
Figure 5:
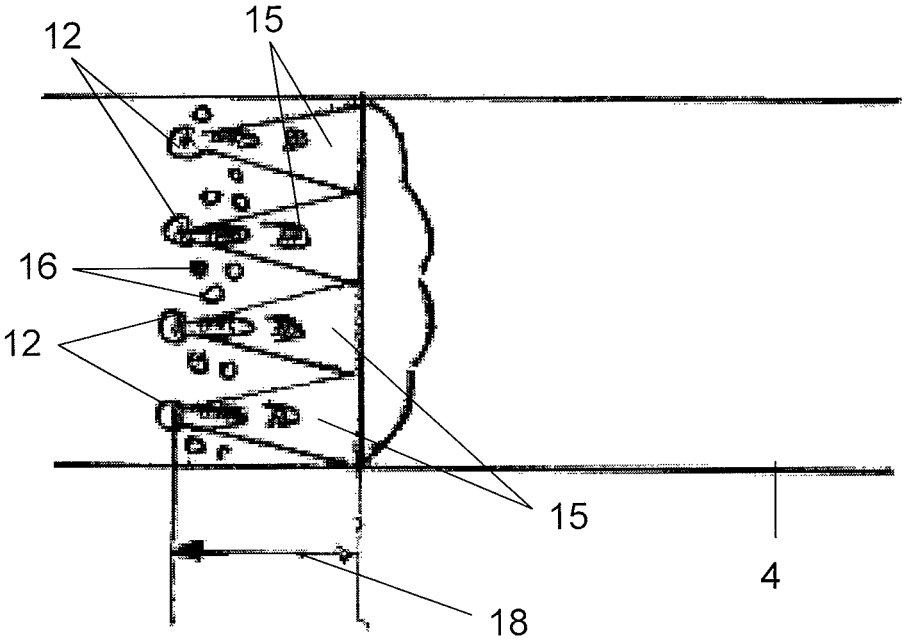
FIG. 5 shows a partial section through part of a U-bend according to the present invention.

FIGS. 4 and 5 will be used to explain, hereinbelow, the difference between a pulse-nozzle arrangement with just one nozzle and a pulse-nozzle arrangement 8 according to the invention.

FIG. 4 shows a U-bend 4 in which the water 13 is accelerated in a known manner by means of just one nozzle 17. A flow cone 14 is formed by the water which flows into the U-bend 4. If solid matter 20 is located downstream of the nozzle 17, as seen in the flow direction, then the flow cone 14 is deflected and may possibly even be directed counter to the flow direction. The water which flows in often gives rise to the formation of air bubbles 16' and corresponding turbulence. This turbulence is comparatively severe and generates comparatively high-level noise.

In the case of the flushing arrangement according to the invention, as has been explained above, a plurality of substantially concentric flow cones 15 are formed in the U-bend 4. These flow cones likewise generate turbulence and air bubbles 16. It has been found that this turbulence generates significantly lower-level noise, and the air bubbles 16 are smaller, than in the case of the prior art according to FIG. 4. It has also been found that the suction function is built up over a comparatively short distance 18. This distance is significantly shorter than the distance 18' according to FIG. 4. Significantly more efficient removal of solid matter 20 is possible by means of the plurality of flow cones 15. Correspondingly, a certain degree of self-cleaning of the U-bend 4 can be achieved. The flow cones 15 can achieve, in adaptation to the U-bend 4, a flow pressure of, for example, 0.04 bar or even a higher flow pressure. This flow pressure can be optimized by the nozzles 12 or 12' being arranged appropriately.

Figure 6:
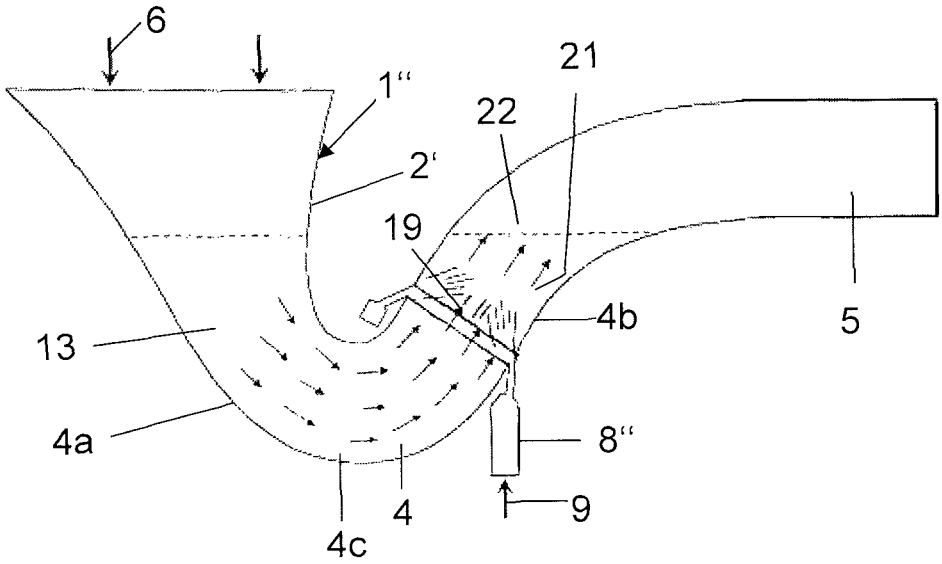
FIG. 6 shows, schematically, a view of a further variant of a flushing arrangement.

FIG. 6 shows a flushing arrangement 1" which differs from the flushing arrangements 1 and 1' by the design of the pulse-nozzle arrangement 8". Instead of the plurality of nozzles 12, or 12', at least one annular gap 19 is provided here, and this opens out, on the inner side 21, into the interior 22 of the U-bend 4. Instead of a plurality of flow cones 15, an annular flow cone is generated here, and this likewise has the effect of accelerating in the direction of the outlet 18 the water which is present in the ascending region 4*b*. The effects are comparable with the flow cones 15 which are generated by the pulse-nozzle arrangements 8 and 8'. The annular gap 19 is comparatively narrow, in which case water flows into the interior 22 at a comparatively high speed and with a comparatively high level of energy. The annular gap 19 can extend around the entire circumference of the U-bend or else around part of the circumference. It is also conceivable to have an embodiment with a plurality of annular gaps 19, for example an embodiment with two approximately diametrically opposite annular gaps 19.

The pulse which is generated by the pulse-nozzle arrangement 8, 8' or 8" can be generated synchronously with the main flushing operation. Also conceivable, however, is an embodiment in which the pulse and the main flushing operation take place one after the other. In particular, the pulse can take place in the U-bend 4 prior to the main flushing operation being triggered.

LIST OF DESIGNATIONS

1 flushing arrangement
2 WC bowl
3 inlet
4 U-bend
5 waste pipe
6 arrow
7 arrow
8 pulse nozzles
9 arrow
10 inlet pipe
11 distributor ring
12 nozzle
13 water
14 flow cone
15 flow cone
16 air bubbles
17 nozzle
18 outlet
19 annular gap
20 solid matter
21 inner side
22 interior
23 inner side
24 mouth
25 mouth

The invention claimed is:

1. A flushing arrangement for a WC, comprising:

a toilet bowl which has an inlet and an outlet and therebetween a U-bend, and pulse generating means for generating a pulse with which water which is present in the U-bend and forms an air trap is accelerated, for a flushing operation, in the direction of the outlet, wherein the pulse generating means are arranged in said U-bend;

wherein the pulse generating means has a plurality of nozzles, or at least one annular gap extending in the circumferential direction of the U-bend, wherein said nozzles or said at least one annular gap generate, in the water in each case, a flow which is directed substantially towards the outlet, and wherein said nozzles or said at least one annular gap are arranged directly upstream of an ascending region or in an ascending region of the U-bend.

2. The flushing arrangement according to claim 1, wherein all the nozzles or the at least one annular gap are or is arranged in the ascending region of the U-bend.

3. The flushing arrangement according to claim 1, wherein the annular gap extends around the entire circumference, or around part of the circumference, of the U-bend.

4. The flushing arrangement according to claim 1, wherein the circumference of the U-bend has arranged on it a distributor ring which is connected to at least two nozzles or to the annular gap.

5. The flushing arrangement according to claim 1, wherein at least a nozzle or the annular gap is operative to feed water, air or a mixture of water and air.

6. The flushing arrangement according to claim 1, wherein the toilet bowl, in the region of the inlet, has means for flushing said toilet bowl with a main flushing operation.

7. The flushing arrangement according to claim 1, wherein said flushing arrangement has a flushing cistern which is connected to the toilet bowl and with which water is fed to at least two nozzles or the annular gap.

8. The flushing arrangement according to claim 7, wherein the flushing cistern is a pressure flushing cistern, and further comprises a line to the at least two nozzles or to the annular gap.

9. A method of operating a flushing arrangement for a WC, which comprises:

a toilet bowl which has an inlet and an outlet and therebetween a U-bend, and pulse generating means for generating a pulse with which water which is present in the U-bend and forms an air trap is accelerated, for a flushing operation, in the direction of the outlet, wherein the pulse generating means are arranged in said U-bend;

wherein the pulse generating means has a plurality of nozzles, or at least one annular gap extending in the circumferential direction of the U-bend, wherein said nozzles or said at least one annular gap generate, in the water in each case, a flow which is directed substantially towards the outlet, and wherein said nozzles or said at least one annular gap are arranged directly upstream of an ascending region or in an ascending region of the U-bend, said method comprising:

during flushing, the water which is present in the U-bend is accelerated in the direction of the outlet by the at least two nozzles or the at least one annular gap.

10. The method according to claim 9, wherein, during flushing, a plurality of flow cones are formed in the U-bend, said flow cones being directed substantially towards the outlet.

11. The method according to claim 10, wherein, during flushing, the toilet bowl is flushed by a main flushing operation, and the main flushing operation is coordinated with the pulse generated in the U-bend.

12. The method according to claim 11, wherein the main flushing operation and the pulse are generated one after the other.

13. The method according to claim 11, wherein the main flushing operation and the pulse are generated substantially simultaneously.

14. The flushing arrangement according to claim 1, wherein said nozzle or said at least one annular gap provide a pulse in direction of the outlet such that a suction effect is achieved in the U-bend.

* * * * *